United States Patent [19]

Mougin

[11] 4,258,640

[45] Mar. 31, 1981

[54] LARGE-SCALE PROTECTIVE DEVICE FOR TABULAR ICEBERGS OR FLOATING STRUCTURES

[75] Inventor: Georges L. Mougin, Paris, France

[73] Assignee: ITT Limited, Paris, France

[21] Appl. No.: 944,287

[22] Filed: Sep. 21, 1978

[30] Foreign Application Priority Data

Oct. 18, 1977 [FR] France ..... 77 31254

[51] Int. Cl.[3] ..... E02B 15/04

[52] U.S. Cl. ..... 114/219; 405/211; 405/61; 405/70

[58] Field of Search ..... 405/61, 63–72, 405/211, 212, 215, 216, 217; 114/219, 220, 266, 267; 9/8 R

[56] References Cited

U.S. PATENT DOCUMENTS

| | | | |
|---|---|---|---|
| 3,289,415 | 12/1966 | Merrill | 61/1 R |
| 3,321,923 | 5/1967 | Smith | 114/267 |
| 3,597,924 | 8/1971 | Risin | 405/71 |
| 3,599,434 | 8/1971 | Missud | 405/68 |
| 3,764,015 | 10/1973 | Rolfson | 405/64 |
| 3,921,407 | 11/1975 | Neal | 405/63 |
| 4,033,137 | 7/1977 | Geist | 405/71 |

FOREIGN PATENT DOCUMENTS

| | | | |
|---|---|---|---|
| 1484360 | 2/1969 | Fed. Rep. of Germany | 405/63 |

*Primary Examiner*—Trygve M. Blix
*Assistant Examiner*—D. W. Keen
*Attorney, Agent, or Firm*—George E. Kersey

[57] ABSTRACT

A large-scale protective device in accordance with the invention comprises an assembly of two types of unit, rigid cylindrical floating towers (3 to 6) and elastic connecting units (7, 8, 9) consisting of elastomer tubes. The generatrices of these elastic connecting units are in contact with vertical stiffeners (10) of the floating towers. These vertical stiffeners also serve to maintain cylindrical deflector rings (11) of the floating towers one above another in a stacked configuration.

14 Claims, 4 Drawing Figures

LARGE-SCALE PROTECTIVE DEVICE FOR TABULAR ICEBERGS OR FLOATING STRUCTURES

The present invention relates to large-scale protective devices for tabular icebergs or floating structures.

The possibility of towing tabular icebergs to tropical countries for use as sources of fresh water has often been discussed. The ice packs most suited to this application are those of the south pole. In this region, the ice does not advance in the form of tongues, but forms a plateau with a well-defined frontier where it meets the ocean. The Antarctic continent is not encircled by mountains, but is bordered by a rim of ice, part of which is supported on the continental shelf and the rest of which floats on the surface of the ocean. Under the pressure of the ice inland, this mass of ice is gradually pushed towards the sea. From time to time tabular icebergs become detached from the ice plateau, and may be of very large size, of the order of several square kilometers. It is then possible to tow these tabular icebergs to the dry regions of both hemispheres located close to the coast. Towing the icebergs from the Antarctic to the Northern Hemisphere at a speed of 0.5 m/s takes several months, however, and requires the application of some means of protecting the side surfaces of the tabular iceberg. One proposal in this connection is the manufacture of insulating skirts placed vertically around the tabular iceberg. A coated or uncoated insulating skirt of woven material or plastics film does not have adequate mechanical characteristics to enable it to withstand waves and swell, which can attain heights of 15 meters under normal conditions.

Thus a floating protective device is indispensable when tabular icebergs are being towed or are moored for utilization. It is necessary to guard against the waves causing erosion of the ice around the waterline. The formation of caves may result in blocks of ice falling into the sea. These blocks of ice represent a danger to shipping, and break away from the vertical side or "cliff" wall of the tabular icebergs. These "cliffs" may have a height of 40 meters above the waterline. This phenomenon is accelerated in tropical regions insofar as the temperature of the seawater in which an iceberg floats after towing is higher than that in the waters close to the Antarctic. As a result, it is necessary to protect the tabular iceberg from this mechanical action and from the violent movement of the sea.

It is evident that the problems posed by the passage of a tabular iceberg through warm tropical waters have not been solved, in particular because "thermal" and "mechanical" protection of the tabular iceberg has not yet been suggested.

Certain operations are required for moving tabular icebergs from the areas in the Antarctic ocean where they are naturally found drifting to other oceans where they are to be utilized on an industrial basis. These operations include:

- the application of considerable tractive or propulsive forces,
- the creation of anchor points for the application of these tractive forces or for immobilising the iceberg at the place where it is utilized on an industrial basis,
- the attaching of a mechanical protective system of the vertical side walls of the tabular iceberg around the waterline to avoid erosion by the action of the waves and the swell, and
- the attaching of a thermal insulation system for the vertical side walls and the substantially horizontal bottom surface of tabular iceberg.

In theory, these various operations may be carried out using the tabular iceberg as a support, requiring the intervention of personnel who must be transported to the iceberg and who may need to remain on it for some time. This constraint limits the choice of tabular icebergs, as most of them are covered with a layer of neve, the intermediate state between snow and ice.

The present invention is intended to provide a large-scale protective device which enables the above-mentioned operations to be carried out without requiring the presence of personnel on the iceberg or floating structure.

The present invention provides a large-scale protective device for tabular icebergs or floating structures, wherein the protective device comprises an assembly of two types of unit; rigid cylindrical floating towers; and elastic connecting units. Thus the protective device consists of offshore floating towers preferably constructed in accordance with a technique originated by the applicant and connected together in such a way as to absorb the variations in level due to movement of the surface of the sea.

Preferred floating towers used within the context of the present invention are made of concrete and have cylindrical seawater deflector rings located above a ring of buoyancy tanks surrounding a pneumatic damper bell. These towers are ballasted at their lower ends. These floating towers are extremely stable in spite of the movement of the surface of the sea, the amplitude of their vertical movement being less than 20% of the height of the swell. These floating towers are of constant diameter at all levels, and vertical stiffeners extend over the entire height of the tower. These stiffeners are required, inter alia, to maintain the deflector rings at a constant distance from one another.

The elastic connecting units are preferably elastomer tubes located on the regions of the floating towers comprising the cylindrical deflector rings. In practice, it is sufficient to provide two sections of elastomer tube between adjacent towers; in other words, it is not necessary to have a tube running over the entire height of the tower. The height of an elastic unit is greater than the distance between two cylindrical deflector rings. In order to avoid damage to the elastomer tubes forming the elastic connecting units, they are located between two vertical stiffeners of the floating towers, each stiffener forming part of a respective floating tower.

The elastic connecting units must be attached to the floating towers insofar as they may be moved away from their operating areas by the relative movement of the floating towers. To hold the elastic connecting units in position between the floating towers there is provided a system of cables attached to the floating towers or to the superstructures thereof. A cable with one end attached to one of the floating towers adjoining an elastic unit, or to the superstructure thereof, passes through said elastic unit; its other end retains a cruciform support for the elastic unit. The cruciform supports for the elastic connecting units have relatively long branches to enable them to embrace a vertical stiffener of each floating tower. In other words, each cruciform support is trapped in a horizontal plane between two opposing vertical stiffeners, and in a vertical plane because of the cable which attaches it to the top of one of the floating towers. The elastic connecting units are prevented from escaping laterally by two U-shaped members attached to the cruciform support at the base. A further cruciform support may be mounted on each elastic connecting unit to provide further lateral location.

The distances between the floating towers are limited in order to provide a continuous belt: the elastic connecting units prevent the floating towers colliding with one another during lateral or vertical movement caused by movement of the surface of the sea; cables prevent the floating towers moving away from one another. Cables for connecting the floating towers together have both ends connected to the same floating tower. These cables pass around at least one vertical stiffener of an adjacent tower. They are stretched tight by pulley blocks located inside the floating towers and associated with winches on said floating towers or the superstructures thereof.

A remarkable feature of the protective device in accordance with the invention, based on the cooperation of identical units which are easy to manufacture, is that it can provide mechanical protection of the side walls of the tabular iceberg or the floating structure around whose waterline it is located. Furthermore, it is possible to suspend from the floating towers a thermal insulation device which provides a vertical layer of cold water along the vertical side walls of the tabular iceberg.

The protective device in accordance with the invention may be made self-propelled by means of propulsion units, for moving it before a tabular iceberg is captured or for moving it to the area in which a floating structure to be moved is being utilized. To this end, fuel tanks may be located inside the floating towers. Because of its various possible forms, the protective device may be used to create an asymmetrical artificial bow, the geometry of which may be varied in accordance with the geographical latitude in order to compensate Coriolis effects.

The invention will now be described in more detail by way of example only.

In the accompanying drawings, which are given by way of non-limiting example only:

Figure 1:
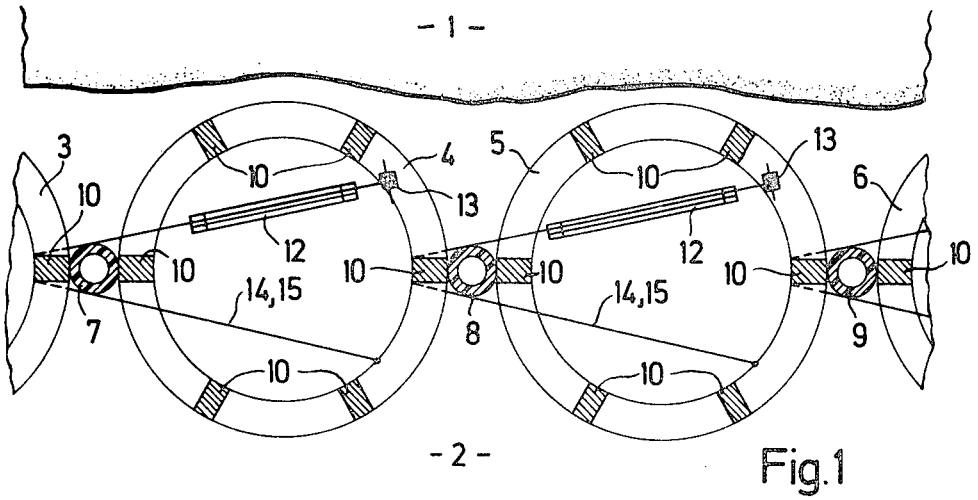
FIG. 1 is a partial plan view in cross-section of a protective device in accordance with the invention.

A list of the reference numerals used in the following description, with the associated items, will be found after the description.

FIG. 1 shows a tabular iceberg (1) floating in the sea (2). Floating towers (3), (4), (5) and (6) are arranged along the vertical side face of the tabular iceberg (1), and between them are elastic connecting units (7), (8) and (9). These elastic connecting units (7), (8) and (9) have their generatrices in contact with vertical stiffeners (10) of the vertical towers (3), (4), (5) and (6). These vertical stiffeners (10) maintain the cylindrical deflector rings (11) of the floating towers one above another, at the required distance. The elastic connecting units (7), (8) and (9) are sections of an elastomer tube with a diameter of approximately 1 meter, as compared with the usual diameter of the floating towers, which is 25 to 30 meters. Floating towers as disclosed in the applicant's French patent application No. FR 77 28859 dated Sept. 26, 1977 have an amplitude of vertical movement which is only 20% of that of the swell. Thus in practice two floating towers will have a difference in level of less than 1 meter, as compared with their height which is around 60 meters. In other words, the level difference is of the order of 1 to 2% of the total height, which can be easily taken up by the elastic connecting units (7), (8) and (9). These elastic units are in contact with two vertical stiffeners (10) each stiffener forming part of a respective floating tower (3), (4), (5) and (6).

Figure 2:
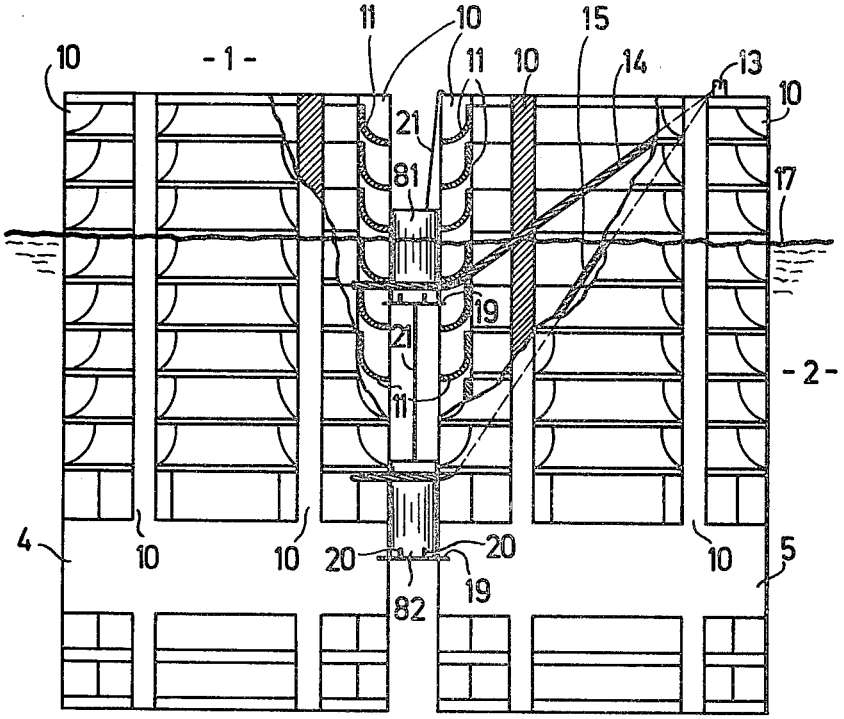
FIG. 2 is a vertical cross-section through two floating towers with elastic connecting units between them.

As is shown in FIG. 2, two elastic connecting units (81) and (82) are located between two floating towers (4) and (5), a certain distance apart. FIG. 2 is a partial cross-section on a vertical plane parallel to the vertical side face (16) of the tabular iceberg (1), and its central portion shows the elastic connecting unit (18) in the vicinity of the surface (17) of the sea (2). It is maintained in position laterally by the cable (14) which is connected to the winch (13). This cable (14) bears against the curved surface of a cylindrical deflector ring (11) so as to extend parallel to the surface (17) of the sea (2) before passing around a vertical stiffener (10). Between the bottom portions of the towers (4) and (5) is located another elastic connecting unit (82) retained laterally by the cable (15). Pulley blocks (12) enable the cables (14) and (15) to be appropriately tensioned by means of the winch (13). The increase in the length of the cables (14) and (15), because of the constant elasticity per unit length, increases the possible extension and enables vertical relative movement of the floating towers (4) and (5) caused by the movement of the surface (17) of the sea (2).

Figure 3:
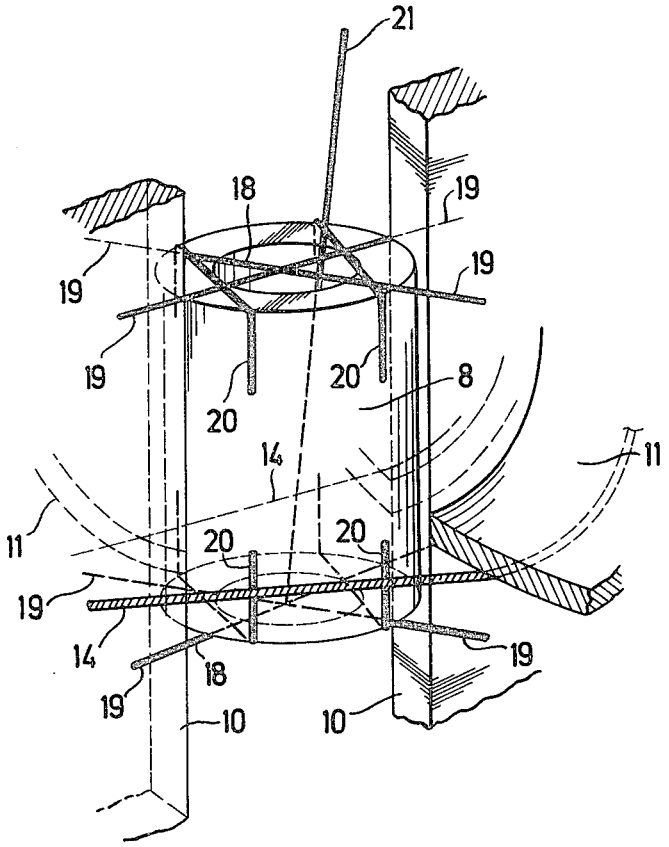
FIG. 3 is a perspective view of a cruciform member retaining the elastic connecting units.

FIG. 3 shows cruciform supports (18) for retaining the elastic connecting units laterally and vertically. The horizontal branches (19) of these supports (18) embrace the vertical stiffeners (10) between which the elastic connecting unit (8) is located, two U-shaped branches (20) preventing this escaping laterally. These branches (20) are attached at the base to the horizontal branches (19). Two cruciform supports (18) are arranged face to face. The upper support is mounted on the elastic connecting unit (8) while the lower support is retained by a cable (21) which is attached to the upper surface of one of the adjacent floating towers. The cable (14) which holds the two towers (4) and (5) parallel to one another can also be seen.

Figure 4:
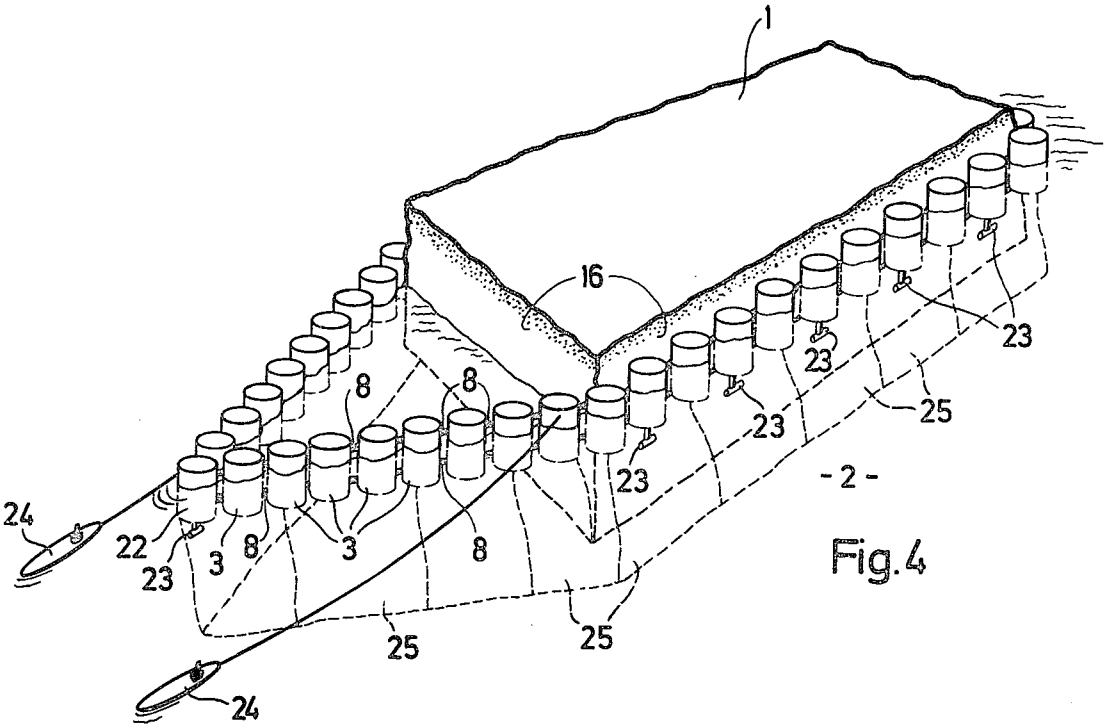
FIG. 4 is a perspective view of a protective device in accordance with the invention, arranged around a tabular iceberg for the purpose of towing it.

FIG. 4 is a schematic perspective view of a protective device in accordance with the invention, showing a tabular iceberg (1) floating in the sea (2), equipped with a mechanical protective device formed by floating towers (3); between adjacent floating towers (3) are interposed elastic connecting units (8). In front of one of the vertical side faces (16) of the tabular iceberg (1), the protective device forms an artificial bow. An artificial bow facilitates the movement of the protected tabular iceberg or floating structure through the sea. The bow floating tower (22) has a propulsion unit (23) at its lower end. So also do a few of the floating towers (3) located along the side of the tabular iceberg (1). The protective device is thus partially self-propelled; tugs (24) facilitate manoeuvres. A thermal protective device (25) as disclosed in the applicant's French patent application No. FR 77 29630 dated Oct. 3, 1977 is suspended from the mechanical protective device formed by the floating towers (3).

I claim:

1. A large-scale protective device for floating structures, wherein the protective device comprises an assemblage of two types of units; rigid cylindrical floating towers and elastic connecting units intercoupling adjoining ones of said towers; and cables for connecting the floating towers together, both ends of each cable being connected to the same floating tower and passing around at least one vertical stiffener of an adjacent tower.

2. A protective device according to claim 1, wherein the connecting units are elastomer tubes.

3. A protective device according to claim 1, wherein two elastic connecting units are inserted between adjacent pairs of floating towers.

4. A protective device according to claim 1, wherein the elastic connecting units are located between two vertical stiffeners of the floating towers, each stiffener forming part of a respective floating tower.

5. A protective device according to claim 1, wherein the elastic connecting units are fastened by means of cables attached to the floating towers or the superstructures thereof above the surface of the sea.

6. A protective device according to claim 1, wherein the connecting cables are stretched taut by pulley blocks located inside the floating towers and associated with winches on said floating towers or the superstructures thereof.

7. A protective device according to claim 1, wherein the protective device is self-propelled by means of propulsion units located beneath the floating towers.

8. A protective device according to claim 1, wherein an artificial bow is formed to facilitate the movement of the protected tabular iceberg or floating structure through the water.

9. A large-scale protective device for tabular icebergs or floating structures wherein the protective device comprises an assemblage of two types of units; rigid cylindrical floating towers and elastic connecting units in the form of elastomer tubes; said elastic connecting units being located on regions of the floating towers including cylindrical deflector rings.

10. A protective device according to claim 9, wherein the height of an elastic connecting unit is greater than the distance between adjacent cylindrical deflector rings of the floating towers.

11. A large-scale protective device for tabular icebergs or floating structures, wherein the protective device comprises an assemblage of two types of units; rigid cylindrical floating towers and elastic connecting units fastened by means of cables attached to the floating towers or a superstructure thereof above the surface of the sea; including a cable which is attached at one end to one of the floating towers adjoining an elastic connecting unit, or to the superstructure thereof, which passes through said elastic connecting unit and which has its other end retaining a cruciform support for said elastic connecting unit.

12. A protective device according to claim 11, comprising cruciform supports for the elastic connecting units with branches which embrace a vertical stiffener of each floating tower.

13. A protective device according to claim 12, including a second cruciform member mounted on each elastic connecting unit.

14. A protective device according to claim 11, comprising cruciform supports with two U-shaped members attached thereto at the base.

* * * * *